US006246950B1

(12) United States Patent
Bessler et al.

(10) Patent No.: US 6,246,950 B1
(45) **Date of Patent: *Jun. 12, 2001**

(54) MODEL BASED ASSESSMENT OF LOCOMOTIVE ENGINES

(75) Inventors: Warren Frank Bessler, Amsterdam; Steven Hector Azzaro, Schenectady, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/303,753

(22) Filed: May 3, 1999

Related U.S. Application Data

(63) Continuation-in-part of application No. 09/145,077, filed on Sep. 1, 1998, now Pat. No. 5,961,567.

(51) Int. Cl.[7] ..... G06F 19/00; G06G 7/70

(52) U.S. Cl. ..... 701/99; 701/29; 701/34; 701/19; 706/50; 706/45; 702/183; 702/187; 318/473

(58) Field of Search ..... 701/99, 19, 20, 701/100, 34, 29; 706/50, 45; 702/34, 183, 187, 185; 340/438, 439, 679; 318/473; 73/117.3

(56) References Cited

U.S. PATENT DOCUMENTS

| | | | | |
|---|---|---|---|---|
| 4,215,412 | | 7/1980 | Bernier et al. | 701/100 |
| 5,103,391 | * | 4/1992 | Barrett | 700/4 |
| 5,298,842 | | 3/1994 | Vanet et al. | 318/473 |
| 5,311,451 | * | 5/1994 | Barrett | 700/278 |
| 5,566,091 | | 10/1996 | Schricker et al. | 702/34 |
| 5,646,341 | | 7/1997 | Schricker et al. | 73/117.3 |
| 5,806,011 | * | 9/1998 | Azzaro et al. | 701/99 |
| 5,845,272 | * | 12/1998 | Morjaria et al. | 706/50 |
| 5,889,205 | * | 3/1999 | Treinies et al. | 73/118.2 |
| 5,961,567 | * | 10/1999 | Azzaro et al. | 701/99 |

* cited by examiner

*Primary Examiner*—Jacques H. Louis-Jacques
(74) *Attorney, Agent, or Firm*—Patrick K. Patnode; Douglas E. Stoner

(57) ABSTRACT

A locomotive for model-based incipient failure detection includes at least one replaceable unit and at least one sensor to generate signals representative of current engine conditions related to the at least one replaceable unit. A controller includes an embedded replaceable unit model algorithm. Current operating conditions and ambient conditions are utilized within the algorithm to generate a model-based predicted value for the at least one sensor. The controller compares the at least one sensor signals to the model-based predicted values for calculating deviations therebetween and detecting incipient failure of the at least one replaceable unit.

19 Claims, 3 Drawing Sheets

MODEL BASED ASSESSMENT OF LOCOMOTIVE ENGINES

CROSS REFERENCE TO A RELATED APPLICATION

This invention is a continuation-in-part of application Ser. No. 09/145,077, of commonly assigned U.S. Pat. No. 5,961,567, filed Sep. 1, 1998, entitled "Method and Apparatus For Performance Based Assessment of Locomotive Diesel Engines," which patent is herein incorporated by reference.

BACKGROUND OF THE INVENTION

The instant invention is directed in general to locomotive diesel engines and related locomotive sub-systems, and more specifically, to a method and apparatus for performance based assessment of a locomotive diesel engine and related sub-systems.

In diesel locomotive operations, a significant concern is the soundness of a locomotive's engine and related sub-systems. Failure of a locomotive's engine and related sub-systems may cause serious damage, costly repairs and significant operational delays. Most often, by the time a problem within a locomotive is detected and located, the degradation is too severe to reverse and part replacement, although costly, is the only alternative.

Accordingly, monitoring a diesel engine and related sub-systems for indications of degradation is a high priority in diesel locomotive operations. Monitoring a locomotive's operation, however, is difficult because of the wide range of operating conditions a locomotive encounters while in use. During a typical operating period, a diesel powered locomotive may travel several thousand miles enduring constant changes in temperature, altitude, load and many other performance variables. With each change in operating conditions, output from a diesel engine changes accordingly. Monitoring the actual performance data from a diesel engine, such as the exhaust temperature or intake air temperature, in order to monitor performance would be nonproductive, as the performance data will vary widely as the many changes in ambient temperature, altitude and load take place during operation.

Therefore, it is apparent from the above that there exists a need in the art for improvements in monitoring a locomotive's operating performance.

SUMMARY OF THE INVENTION

A locomotive for model-based incipient failure detection includes at least one replaceable unit and at least one sensor to generate signals representative of current engine conditions related to the at least one replaceable unit. A controller includes an embedded replaceable unit model algorithm. Current operating conditions and ambient conditions are utilized within the algorithm to generate a model-based predicted value for the at least one sensor. The controller compares the at least one sensor signals to the model-based predicted values for calculating deviations therebetween and detecting incipient failure of the at least one replaceable unit.

DETAILED DESCRIPTION OF THE INVENTION

Figure 1:
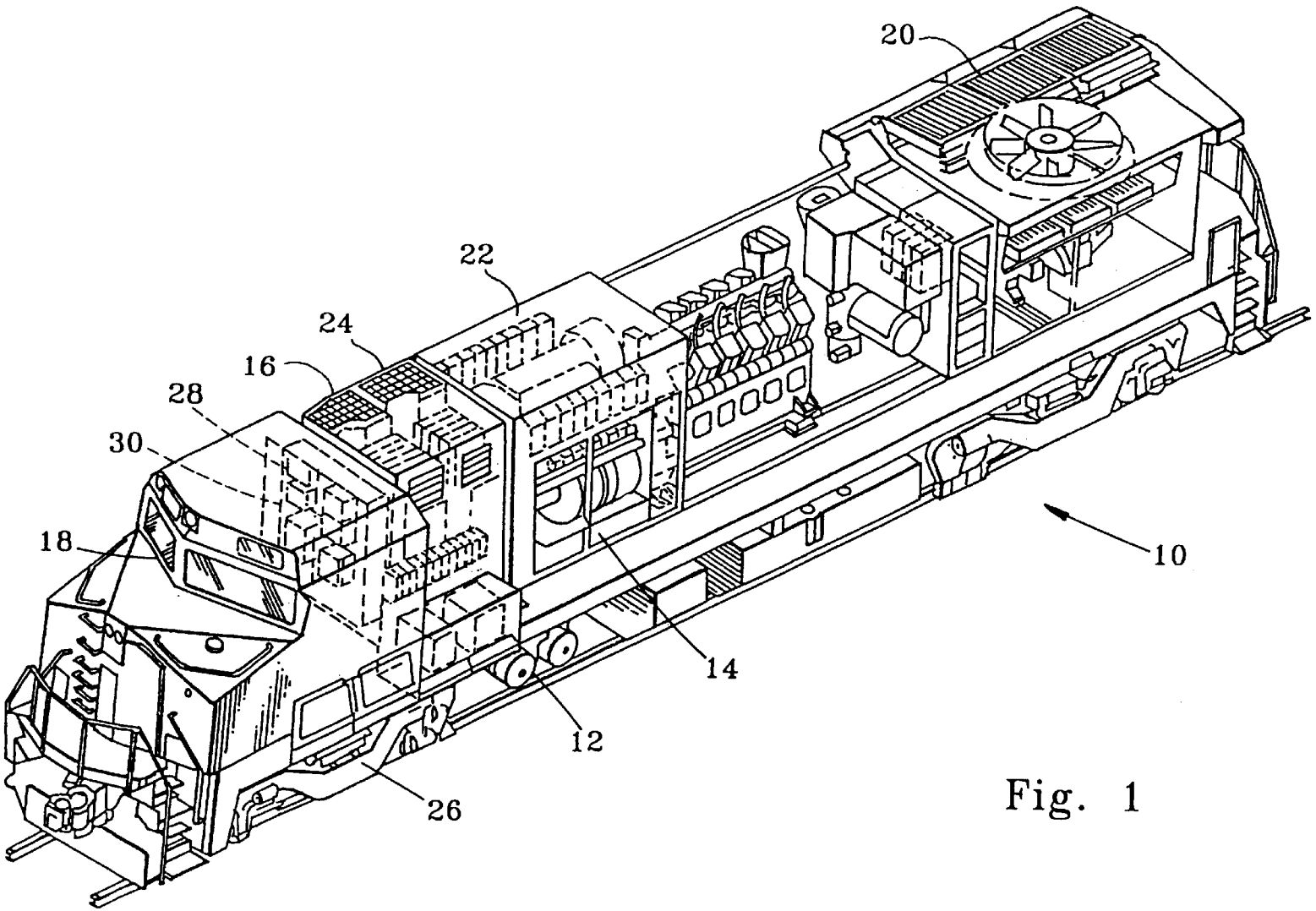
FIG. 1 shows a schematic of a locomotive.

FIG. 1 shows a schematic of a locomotive 10. The locomotive may be either an AC or DC locomotive. The locomotive 10 is comprised of several complex sub-systems, each performing separate functions. Some of the sub-systems and their functions are listed below. Note that the locomotive 10 is comprised of many other sub-systems and that the present invention is not limited to the sub-systems disclosed herein.

An air and air brake sub-system 12 provides compressed air to the locomotive, which locomotive uses the compressed air to actuate the air brakes on the locomotive and attached cars.

An auxiliary alternator sub-system 14 powers all auxiliary equipment. In particular, auxiliary alternator sub-system 14 supplies power directly to an auxiliary blower motor and an exhauster motor. Other equipment in the locomotive is powered through a skipper cycle.

A battery and cranker sub-system 16 provides voltage to maintain the battery at an optimum charge and supplies power for operation of a DC bus and an HVAC system.

An intra-consist communications sub-system collects, distributes, and displays consist data across all locomotives in the consist.

A cab signal sub-system 18 links the wayside to the train control system. In particular, system 18 receives coded signals from the rails through track receivers located on the front and rear of the locomotive. The information received is used to inform the locomotive operator of the speed limit and operating mode.

A distributed power control sub-system provides remote control capability of multiple locomotive consists anywhere in the train. The distributed power control sub-system also provides for control of tractive power in motoring and braking, as well as air brake control.

An engine cooling sub-system 20 provides the means by which the engine and other components reject heat to the cooling water. In addition, engine cooling sub-system 20 minimizes engine thermal cycling by maintaining an optimal engine temperature throughout the load range and prevents overheating in tunnels.

An end of train sub-system provides communication between the locomotive cab and the last car via a radio link for the purpose of emergency braking.

An equipment ventilation sub-system 22 provides the means to cool the locomotive equipment.

An event recorder sub-system records FRA required data and limited defined data for operator evaluation and accident investigation. The event recorder can store up to 72 hours of data.

A fuel monitoring sub-system provides means for monitoring the fuel level and relaying the information to the crew.

A global positioning sub-system uses NAVSTAR satellite signals or the like to provide accurate position, velocity and altitude measurements to the control system. In addition, the global positioning sub-system also provides a precise UTC reference to the control system.

A mobile communications package sub-system provides the main data link between the locomotive and the wayside via a 900 MHz radio.

A propulsion sub-system 24 provides the means to move the locomotive. Propulsion syb-system 24 also includes the traction motors and dynamic braking capability. In particular, propulsion sub-system 24 receives power from the traction alternator and through the traction motors, and converts the power to locomotive movement.

A shared resources sub-system includes the I/O communication devices, which communication devices are shared by multiple sub-systems.

A traction alternator sub-system 26 converts mechanical power to electrical power that is provided to the propulsion sub-system 24.

A vehicle control system sub-system reads operator inputs and determines the locomotive operating modes.

The above-mentioned sub-systems are monitored by a locomotive control system 28 or onboard monitoring system located in the locomotive. The locomotive control system 28 keeps track of any incidents occurring in the sub-systems with an incident log. An on-board diagnostics sub-system 30 receives the incident information supplied from the control system and maps some of the recorded incidents to indicators. The indicators are representative of observable symptoms detected in the sub-systems. The on-board diagnostic sub-system 30 then determines a list of the most likely causes for any locomotive failures, as well as providing a list of corrective actions to take to correct the failures. In addition, the on-board diagnostics system can request that certain manual indicators located about the sub-system be checked, and based on the status of the manual indicators, refines the diagnosis to provide better results. The processing of incidents, indicators or problem identification can be done on-board or off-board.

Federal regulation requires that locomotives be serviced periodically, typically every 92 days. While in the shop, each locomotive undergoes a conventional service and maintenance check. These checks include partial locomotive disassembly to expose "replaceable units" and visual inspection and possibly electrical testing of the replaceable units for problems. Defective replaceable units are replaced. A replaceable unit (RU) is the smallest replaceable assembly of parts. For example, locomotives have several fans needed to cool various components including the motor or motors. Badly worn fan bearings eventually will lead to cooling fan stoppage, and a locomotive motor can overheat and fail without adequate cooling from a cooling fan. The cooling fan, and not the fan bearing, is the replaceable unit. A locomotive that becomes disabled while in operation between shop visits is a cost liability to the railroad.

As seen above, a locomotive has many sub-systems comprised of replaceable units (RU) that have failure modes. Each of these sub-systems or replaceable units are amenable to incipient detection.

Figure 2:
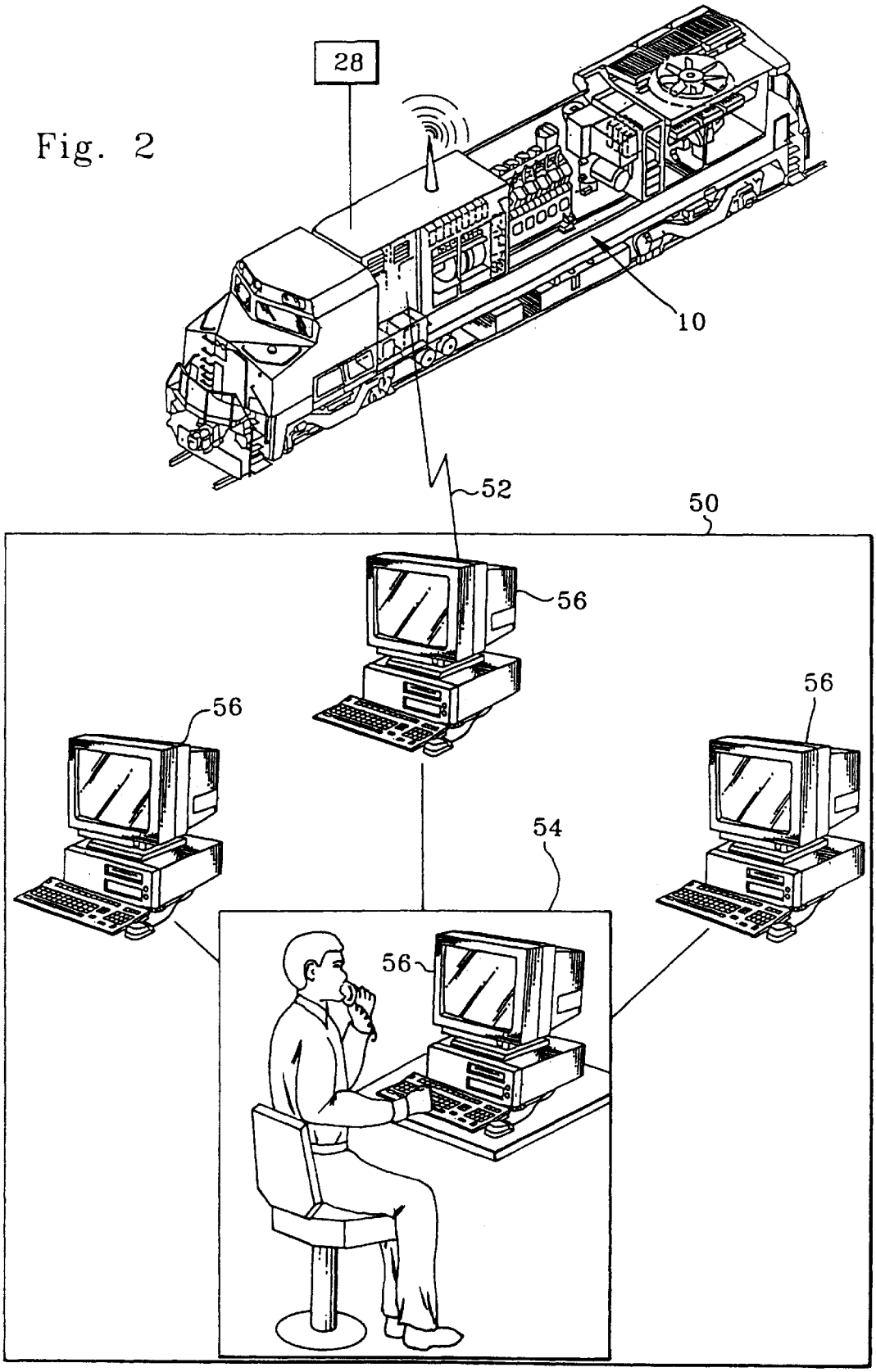
FIG. 2 shows a schematic of a locomotive and communication to a remote service center.

Numerous sensors are positioned about a locomotive to generate signals to on-board locomotive control system 28, as depicted in FIG. 2. Sensors include, for example, temperature sensors, pressure sensors, accelerometers, speed sensors, notch position sensors, gross horse power sensors, RPM current sensors, and voltage sensors. The signals generated by each sensor are collected, stored and processed within on-board locomotive control system 28. In another embodiment, control system can be an off-board monitoring system. For example, the signals from the sensors can be communicated to a remote service center for collection, storing and processing.

As discussed above, performance data can vary widely during ranges of ambient conditions and operation conditions. Because of the constant changes in operating conditions and ambient conditions, the sensed data performance must be standardized to determine if the signal is within specifications.

In order to produce this standardization, models are created for replaceable units or sub-systems in need of monitoring. The model is typically a series of equations and assumptions that are true for all possible operating conditions, including sharp changes in ambient conditions. The model, typically in algorithm form, receives the data sets from the locomotive and runs the data sets through the model's equations and assumptions. The model algorithm can be programmed in, for example, C, C++, JAVA, Basic, MATLAB or Fortran programming languages.

The model algorithm generates model-based predicted values based on the operating conditions and ambient conditions. The model-based predicted values are compared to the actual sensed values to find deviation between the two. If the sensed values are a predetermined percentage different from the predicted values, an incipient failure is indicated. If the change is increasing or decreasing, this also could be an indication of incipient failure.

The data collected from the sensors are typically sent to a remote service 50 center through a communications link 52. Once the data sets are received by remote service center 50, the data sets are stored, automatically processed and generate automated notification. At remote service center 50 a user 54 typically performs call tracking, data visualization and field notification.

Communications link 52 may, for example, be by way of a "geo-synchronous," "L-band" stelllite system, a "Little Leo" system, or any communication system capable of two-way communication between remote service center 50 and locomotive 10.

In one embodiment of the instant invention, a thermal incipient failure detection (TIFD) model is utilized. A control structure is inputted into circuitry, for example, by programming into memory of an application specific integrated circuit (ASIC) or is embedded in the form of algorithms in one or more computers such as a work station 56. Other types of computers can be used, however, such as a minicomputer, a microcomputer, a supercomputer or an onboard locomotive monitoring sub-system.

Figure 3:
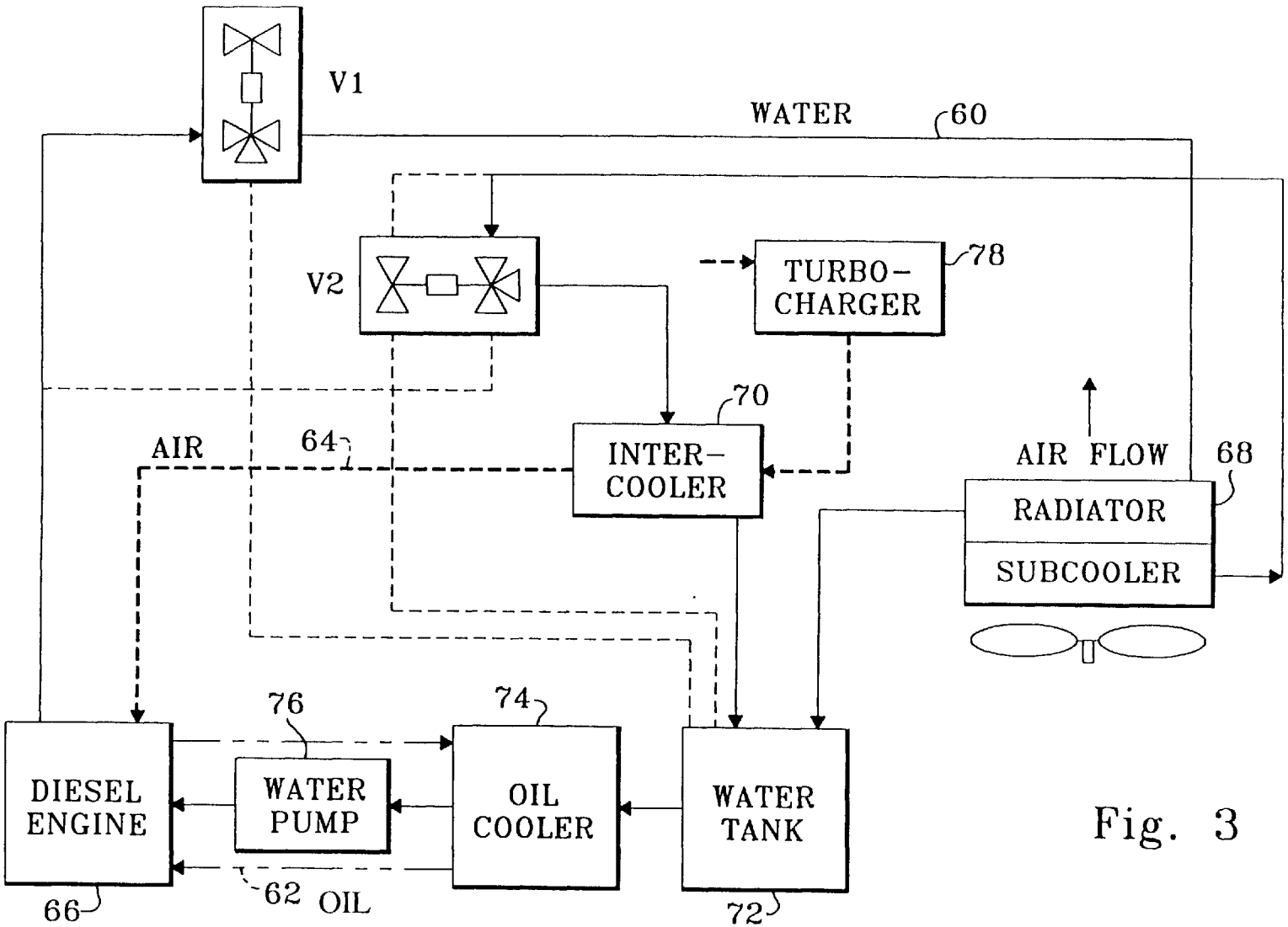
FIG. 3 shows a schematic of an exemplary thermal streams loop.

An exemplary thermal streams loop schematic is shown in FIG. 3. A cooling water loop 60, an oil loop 62 and an air loop 64 are the primary components within the thermal model. Cooling water loop 60 is comprised of a diesel engine 66, one or more radiators 68, an intercooler 70 and a water tank 72. The oil loop is comprised of diesel engine 66, an oil cooler 74 and an oil pump 76. The engine air loop is comprised of a turbo-charger 70 and intercooler 70.

The TIFD model utilizes numerous locomotive sensors, including, for example, a notch position sensor, a Horse Power sensor, a COP pressure sensor, an RPM sensor or a load sensor, to determine if engine output is acceptable and COP is close to an expected value. Additionally, the TIFD model uses fuel pressure and fuel temperature along with locomotive Air Fuel ratio and fuel value and the ambient temperature to determine if a fuel filter is plugged or if fuel is overheated. The TIFD-model also uses the ambient temperature and pressure, the manifold temperature and pressure and exhaust pre-turbine temperature and turbo inlet pressure to determine if the air filters are plugged or if summer or winter doors are in the wrong position. The TIFD-model uses the oil pressure and the oil temperature out with the pressure at the pump outlet to determine if the oil level is low or if the oil filters are plugged. The TIFD-model uses the locomotive inlet water temperature and pressure and the intercooler temperature out along with the radiator fan status and water valve command status to determine if the valves are stuck or if the water level is low. To run a complete TIFD-model, the following inputs are typically needed: engine RPM, engine horsepower, ambient temperature, barometric pressure, status of the cooling system valves, notch call, load control position and crankcase pressure.

As discussed above, the cooling water loop is comprised of the engine, the radiator(s), the intercooler and the water tank. In one embodiment, the TIFD-model receives input from sensors measuring the temperature of the engine water out, the temperature of intercooler water out, the temperature of engine water in, the temperature of the tank water out and the water pressure. The TIFD-model determines the water flow path from the cooling mode, the radiator fan airflow from the ambient temperature and pressure and the cooling mode, and the water tank energy balance from the intercooler temperature out, the radiator temperature out and the tank temperature out.

The TIFD-model assumptions include that the radiators and sub-coolers are modeled by fixed UA for each subcomponent; that the cooling air for radiators and sub-coolers is a function of ambient temperature and train speed; that the tank is well mixed with shell loss proportional to the tank to ambient temperature differentials.

Based on the above sensor inputs, calculations and model assumptions, the TIFD-model compares the actual water flow rate with model-based predicted water flow rate based on engine RPM; the radiator outlet temperature with the model based radiator outlet temperature; and the oil cooler water inlet temperature with the model-based predicted value.

As discussed above, the oil loop is comprised of the oil cooler, the oil pump and the engine. In one embodiment, the TIFD-model receives input from sensors measuring the inlet water temperature from a tank model or tank exit sensor, the engine outlet oil temperature from an engine sensor, the oil pressure into the engine and the oil pressure at the pump outlet. The TIFD-model calculates the oil heat rate and flow rate from an engine model, the water flow rate from an engine model, and the oil pressure based on flow rate.

Based on these inputs, calculations and assumptions, the TIFD-model compares the outlet water temperature to the sensor-temperature engine inlet water, the calculated oil temperature is compared to the sensed temperature—engine inlet oil temperature and the oil pressure is compared to the $\Delta P$ across filters.

As discussed above, the air sub-system loop is comprised of the turbo-charger and the intercooler. In one embodiment, the TIFD-model receives input from sensors monitoring ambient temperature and pressure, intercooler water temperature out, manifold pressure and temperature, exhaust pre-turbine temperature and turbo engine inlet air pressure. The TIFD calculates the turbo RPM, the turbo mass flow rate and the discharge temperature and corrected turbo P ratio. The TIFD-model assumptions include that the water inlet temperature, mass flow rate and inlet air temperature can predict manifold temperature and water out temperature, discharge temperature, and air flow rate given RPM and engine HP, air inlet temperature and pressure, and ambient temperature corrected P ratio given the turbo RPM.

Based on the above sensor inputs, calculations and model assumptions, the TIFD-model compares the manifold temperature to sensed value, the manifold pressure to the sensed value, the turbo RPM to the sensed value, the intercooler water out temperature to the sensed value and the air filter $\Delta P$ is compared to an expected value.

While only certain features of the invention have been illustrated and described, many modifications and changes will occur to those skilled in the art. It is, therefore, to be understood that the appended claims are intended to cover all such modifications and changes as fall within the true spirit of the invention

We claim:

1. A locomotive for model-based incipient failure detection, said locomotive comprising:

at least one locomotive replaceable unit;

at least one sensor to generate signals representative of current engine conditions related to said at least one replaceable unit; and a controller including an embedded replaceable unit model algorithm wherein current operating conditions and ambient conditions are utilized to generate a model-based predicted value for said at least one sensor;

wherein said controller compares said at least one sensor signals to said model-based predicted values for calculating deviations therebetween.

2. A locomotive in accordance with claim 1, wherein said algorithm is programmed in a language selected from the group of C, C++, JAVA, Basic, MATLAB and Fortran.

3. A locomotive in accordance with claim 1, wherein said controller is selected from the group consisting of a work station, a minicomputer, a microcomputer or a super computer, an onboard locomotive control sub-system, or an onboard locomotive monitoring system.

4. A locomotive in accordance with claim 1, wherein said at least one sensor is selected from the group of sensors consisting of temperature sensors, pressure sensors, accelerometers, speed sensors, notch position sensors, gross horse power sensors, RPM current sensors, and voltage sensors.

5. A locomotive in accordance with claim 1 further comprising a communications link.

6. A locomotive in accordance with claim 5 wherein said communication link is selected from the group consisting of a geo-synchronous L-Band satellite system and a little LEO system.

7. A model based incipient failure detection system for detecting incipient failure in at least one locomotive replaceable unit, said system comprising:

at least one sensor to generate signals representative of current engine conditions related to said at least one replaceable unit; and a controller including an embedded replaceable unit model algorithm wherein current operating conditions and ambient conditions are utilized to generate a model-based predicted value for said at least one sensor;

wherein said controller compares said at least one sensor signal to said model-based predicted values for calculating deviations therebetween.

8. A system in accordance with claim 7, wherein said algorithm is programmed in a language selected from the group of C, C++, JAVA, Basic, MATLAB and Fortran.

9. A system in accordance with claim 7, wherein said controller is selected from the group consisting of a work station, a minicomputer, a microcomputer or a super computer, or an onboard locomotive control sub-system.

10. A system in accordance with claim 7, wherein said at least one sensor is selected from the group of sensors consisting of temperature sensors, pressure sensors, accelerometers, speed sensors, notch position sensors, gross horse power sensors, RPM current sensors, and voltage sensors.

11. A system in accordance with claim 7 further comprising a communications link.

12. A system in accordance with claim 11 wherein said communication link is selected from the group consisting of a geo-synchronous L-Band satellite system and a little LEO system.

13. A model-based incipient failure detection system for detecting incipient failure in at least one locomotive replaceable unit onboard a locomotive, said system comprising:

at least one sensor to generate signals representative of current engine conditions related to said at least one replaceable unit;

a communications link between said locomotive and a remote service center;

a control structure including an embedded replaceable unit model algorithm wherein current operating conditions and ambient conditions are received through said communication link and are utilized to generate a model-based predicted value for said at least one sensor;

wherein said control structure compares said at least one sensor signal to said model based predicted values for calculating deviations therebetween.

14. A system in accordance with claim 13, wherein said control structure is inputted into circuitry by programming into an application specific integrated circuit.

15. A system in accordance with claim 13, wherein said control structure is inputted into one or more computers.

16. A system in accordance with claim 13, wherein said algorithm is programmed in a language selected from the group of C, C++, JAVA, Basic, MATLAB and Fortran.

17. A system in accordance with claim 15, wherein said computer is selected from the group consisting of a work station, a minicomputer, a microcomputer or a super computer.

18. A system in accordance with claim 13, wherein said at least one sensor is selected from the group of sensors consisting of temperature sensors, pressure sensors, accelerometers, speed sensors, notch position sensors, gross horse power sensors, RPM current sensors, and voltage sensors.

19. A system in accordance with claim 13 wherein said communication link is selected from the group consisting of a geo-synchronous L-Band satellite system and a little LEO system.

* * * * *